US012329294B2

(12) United States Patent
Chen

(10) Patent No.: US 12,329,294 B2
(45) Date of Patent: Jun. 17, 2025

(54) CONTAINING STRUCTURE

(71) Applicant: WONDERLAND SWITZERLAND AG, Steinhausen (CH)

(72) Inventor: Yanmin Chen, Dongguan (CN)

(73) Assignee: Wonderland Switzerland AG, Steinhausen (CH)

( * ) Notice: Subject to any disclaimer, the term of this patent is extended or adjusted under 35 U.S.C. 154(b) by 162 days.

(21) Appl. No.: 17/569,614

(22) Filed: Jan. 6, 2022

(65) Prior Publication Data

US 2022/0218120 A1 Jul. 14, 2022

(30) Foreign Application Priority Data

Jan. 8, 2021 (CN) ..... 202120051548.4

(51) Int. Cl.
*A47D 7/00* (2006.01)

(52) U.S. Cl.
CPC ..... *A47D 7/002* (2013.01)

(58) Field of Classification Search
CPC ..... A47D 7/00; A47D 7/002; A47D 7/005; A47D 7/02; A47D 13/06; A47D 13/061; A47D 13/063; A47D 13/066
See application file for complete search history.

(56) References Cited

U.S. PATENT DOCUMENTS 5,768,722 A * 6/1998 Olson ..... A47C 19/20 160/368.1
5,957,436 A * 9/1999 Ristau ..... A47D 13/063 256/25
6,067,676 A * 5/2000 Carnahan ..... E04H 15/44 5/98.1
6,182,308 B1 * 2/2001 Yang ..... A47D 9/016 24/616
9,144,325 B1 * 9/2015 Sousa ..... A47D 7/002
10,448,752 B1 * 10/2019 Flannery ..... A47D 13/063
11,202,519 B1 * 12/2021 Flannery ..... A47D 9/005
(Continued)

FOREIGN PATENT DOCUMENTS

CN 1838902 A 9/2006

OTHER PUBLICATIONS

Office Action issued in Taiwanese Application No. 111100618 dated Feb. 21, 2023.

*Primary Examiner* — George Sun
(74) *Attorney, Agent, or Firm* — Volpe Koenig

(57) ABSTRACT

The disclosure provides a containing structure including a main body with a containing chamber, and a door body is disposed on the main body and is openable to enter the containing chamber, a connecting assembly for opening and closing the door body on the main body is disposed between the door body and the main body; and a locking assembly for switching the connecting assembly between a locking state and an unlocking state is disposed on the containing structure. In the containing structure body, when the door body is closed, the connecting assembly is located outside the main body and locked by the locking assembly, for preventing damage caused by improper operation of the infant; only when the locking component is unlocked, the connecting assembly can be operated to open the door body. The containing structure is simple, safe, and reliable, and is suitable for widespread use.

16 Claims, 9 Drawing Sheets

(56) References Cited

U.S. PATENT DOCUMENTS

2005/0034232 A1* 2/2005 Martin ..... A47D 7/02 5/93.1
2005/0150046 A1* 7/2005 Gehr ..... A47D 13/063 5/99.1
2006/0168722 A1* 8/2006 Ramirez ..... A61G 7/0526 5/98.1
2007/0062651 A1* 3/2007 Lippard ..... A01K 1/035 160/135
2007/0214576 A1* 9/2007 Espenshade ..... A47D 15/003 5/99.1
2008/0209631 A1* 9/2008 Thomas ..... A47D 13/063 5/99.1
2009/0049605 A1* 2/2009 Zhao ..... A47D 15/00 5/93.1
2012/0012801 A1* 1/2012 Burns ..... A47D 13/06 256/25
2012/0216346 A1* 8/2012 Rampton ..... A47D 13/061 256/25
2014/0191173 A1* 7/2014 Saint ..... A47D 13/06 256/25
2014/0208505 A1* 7/2014 Burkholder ..... A47D 7/002 5/99.1
2015/0021453 A1* 1/2015 Brassard ..... A45F 5/00 29/401.1
2016/0374481 A1* 12/2016 Sclare ..... G03B 29/00 5/93.2
2017/0065100 A1* 3/2017 Lange ..... A47D 13/063
2017/0312644 A1* 11/2017 Meir ..... E04H 4/0056
2018/0055241 A1* 3/2018 Mallory ..... A47C 29/003
2018/0214728 A1* 8/2018 Ben Meir ..... E04H 4/0056
2019/0335702 A1* 11/2019 Thrift ..... E04H 15/48
2020/0352352 A1* 11/2020 Fusco ..... A47D 13/061
2020/0352353 A1* 11/2020 Fusco ..... A47D 13/061
2022/0064992 A1* 3/2022 Williams ..... E05B 65/0007
2022/0225785 A1* 7/2022 Morris ..... A47C 29/003

* cited by examiner

CONTAINING STRUCTURE

CROSS-REFERENCE TO RELATED APPLICATIONS

This application claims priority to Chinese Application No. 202120051548.4, filed on Jan. 8, 2021, which is incorporated herein by reference in its entirety.

TECHNICAL FIELD

The disclosure relates to the technical field of baby products, and particularly to a containing structure.

BACKGROUND

A family with a baby generally has a crib or other carrier and playpen and so forth for accommodating babies, and in order to facilitate a caregiver to put the baby in or out, zipper doors will be installed in corresponding places of these objects.

SUMMARY

The object of the disclosure is to provide a containing structure with a simple, safe and reliable structure.

In order to achieve the above object, the disclosure provides a containing structure, wherein the containing structure includes a main body with a containing chamber, a door body is disposed on the main body and is openable to enter the containing chamber, a connecting assembly is disposed between the door body and the main body and is used to open and close the door body on the main body; and a locking assembly is disposed on the containing structure and is used to switch the connecting assembly between a locking state and an unlocking state.

The containing structure according to the disclosure is used to protect the infant, wherein the containing structure includes a main body with a containing chamber, and a door body for allowing the infant to enter the containing chamber is disposed on the main body. A connecting assembly is disposed between the door body and the main body, and the door body could be opened or closed on the main body through the connecting assembly. In the containing structure according to the disclosure, when the door body is closed, the connecting assembly is located outside the main body, so that the infant in the containing chamber cannot touch the connecting assembly, which is safe and reliable. Moreover, the connecting assembly may be locked outside the main body by the locking assembly, so that the infant outside the containing chamber cannot operate the connecting assembly, which is safe and reliable.

In an embodiment of the disclosure, when the door body is closed, the connecting assembly is located outside the main body and locked by locking of the locking assembly, and the connecting assembly is unlocked by unlocking of the locking assembly so as to open the door body.

In an embodiment of the disclosure, the locking assembly includes a first locking portion and a second locking portion which are detachably connected, the first locking portion is connected with the main body, the second locking portion is connected with the connecting assembly, and the first locking portion is connected with the second locking portion, such that the connecting assembly is locked; and the first locking portion is detached from the second locking portion such that the connecting assembly is unlocked.

In an embodiment of the disclosure, the first locking portion and the second locking portion are in a detachable plug-fitting structure; or the first locking portion and the second locking portion are in a detachable paste-fitting structure; or the first locking portion and the second locking portion are in a detachable suction-fitting structure; or the first locking portion and the second locking portion are in a detachable sleeve-fitting structure; or the first locking portion and the second locking portion are in a detachable lace-fitting structure.

In an embodiment of the disclosure, the main body includes a supporting assembly and a seat cloth sleeved on the supporting assembly, and the seat cloth is supported on the supporting assembly to form the containing chamber.

In an embodiment of the disclosure, the door body is arranged on the seat cloth, and the door body is openable and closable with respect to the seat cloth.

In an embodiment of the disclosure, the locking assembly also includes a first connecting member, the first connecting member has one end connected to the first locking portion, and the other end connected to the supporting assembly or the seat cloth.

In an embodiment of the disclosure, the first connecting member is a flexible structure.

In an embodiment of the disclosure, a fixing portion for connecting with the supporting assembly is provided on an end of the first connecting member.

In an embodiment of the disclosure, the first connecting member is detachably installed on the supporting assembly through the fixing portion.

In an embodiment of the disclosure, the fixing portion is arranged around the supporting assembly; or the fixing portion is sleeved on the supporting assembly; or the fixing portion is detachably sleeved on and abutted against the supporting assembly; or the fixing portion is snap-fitted on the supporting assembly.

In an embodiment of the disclosure, the supporting assembly includes a bracket and a bottom frame which are foldable, the bracket is connected to the bottom frame, and the fixing portion is connected to the bottom frame.

In an embodiment of the disclosure, the first connecting member has an end fixedly connected with the first locking portion, and the other end fixedly connected with the seat cloth.

In an embodiment of the disclosure, the first connecting member is fixed on a surface of the seat cloth disposed with the door body; or the first connecting member is fixed on a surface of the seat cloth adjacent to the door body; or the first connecting member is fixed on the door body.

In an embodiment of the disclosure, the locking assembly further includes a second connecting member with one end for connecting to the connecting assembly and the other end for connecting to the second locking portion, such that the second locking portion is connected to the connecting assembly through the second connecting member.

In an embodiment of the disclosure, the locking assembly is disposed on the connecting assembly.

In an embodiment of the disclosure, the connecting assembly includes an operating element for operation, and the number of the operating elements is two; when the door body is closed, the locking assembly is locked by being locked between the two operating elements.

In an embodiment of the disclosure, the main body is any one of a crib, a stroller, a safety seat, or a sleeping box.

LIST OF REFERENCE SIGNS

100 containing structure; 101 main body; 102 containing chamber;

10 supporting assembly; 11 bracket; 12 bottom frame;

20 seat cloth; 21 door body; 22 connecting assembly; 221 Zipper; 222 zipper head; 2221 fixing hole;

30, 30*a*, 30*b*, 30*c* locking assembly; 31, 31*a* first fixing member; 311, 311*a* first locking portion; 312, 312*a* first connecting member; 313, 313*a* fixing portion; 32, 32*a* second fixing member; 321, 321*a* second locking portion; 322, 322*a* second connecting member.

DETAILED DESCRIPTION

In order to explain the technical contents and structural features of the present enclosure in detail, the further description will be given below in conjunction with the embodiments and the accompanying drawings.

General zipper doors have no safety devices, and the children can pull them at will, such that it is easy to pinch the child's body during the pulling process, which brings a certain potential safety hazard. Therefore, there is an urgent need for a containing structure with a simple, safe, and reliable structure.

In the containing structure according to the disclosure, the door body may be opened or closed with respect to the main body through the connecting assembly. When the door body is closed, the connecting assembly may be locked outside the main body by the locking assembly, which may prevent damage caused by improper operation of the infant; when the locking assembly is unlocked, the connecting assembly could be operated to open the door body, so as to obtain a simple, safe, and reliable structure and be suitable for wide promotion and use.

Figure 1:
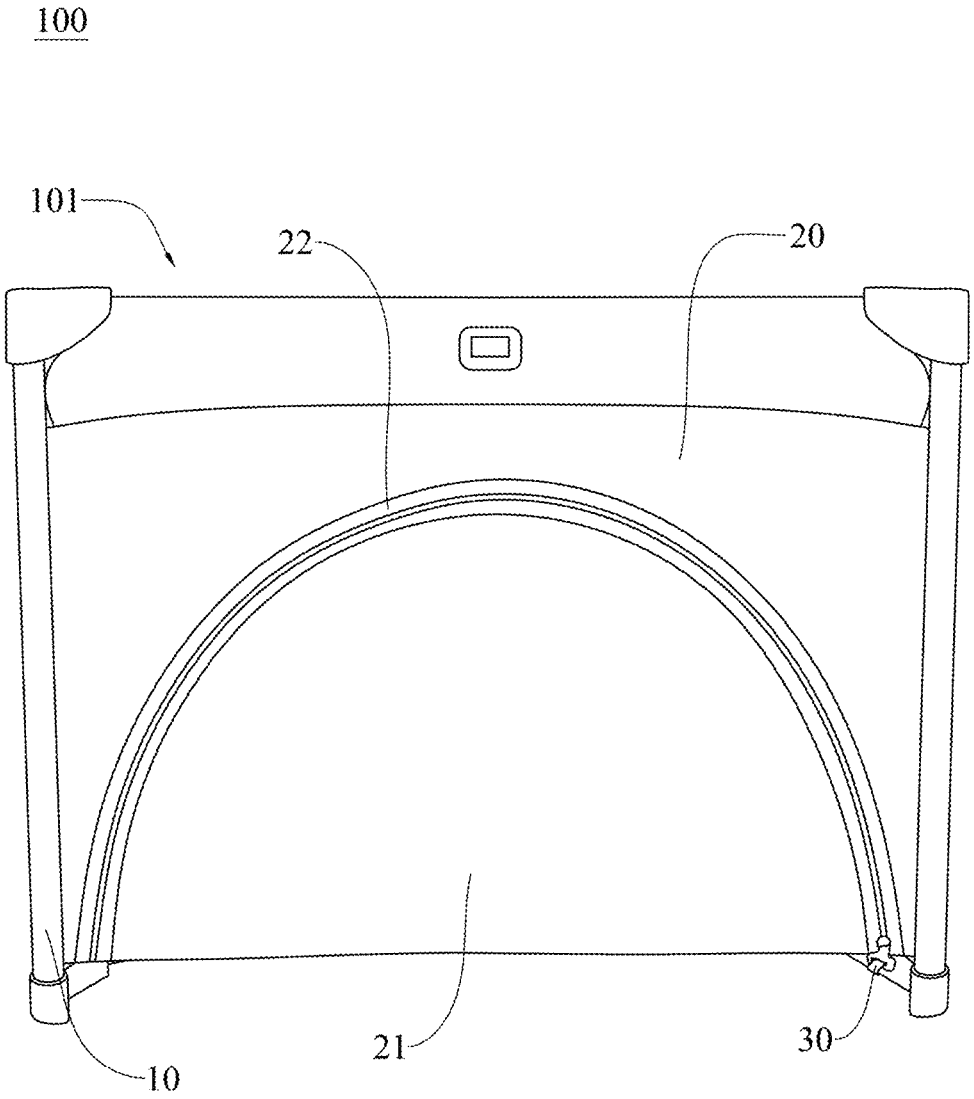
FIG. 1 is a structural schematic diagram of an infant carrier provided by an embodiment of the disclosure.
Figure 2:
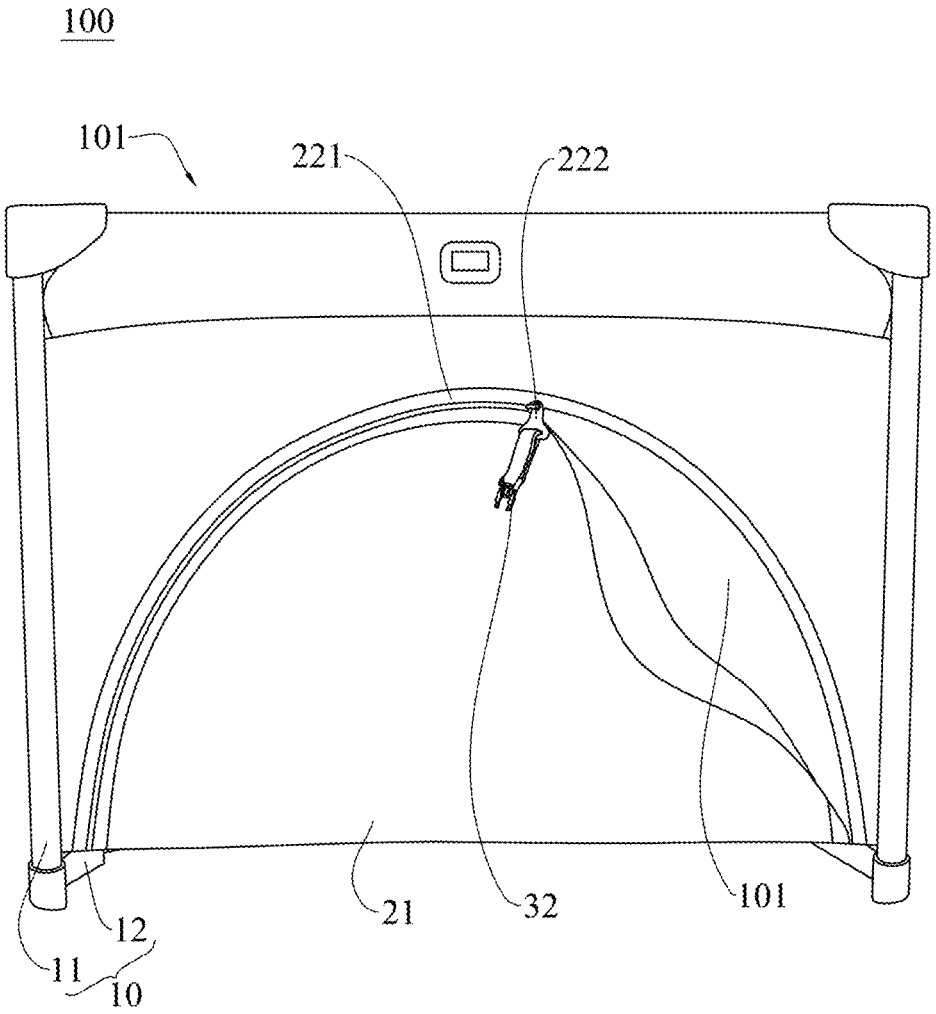
FIG. 2 is a structural schematic diagram of FIG. 1 in another state.
Figure 3:
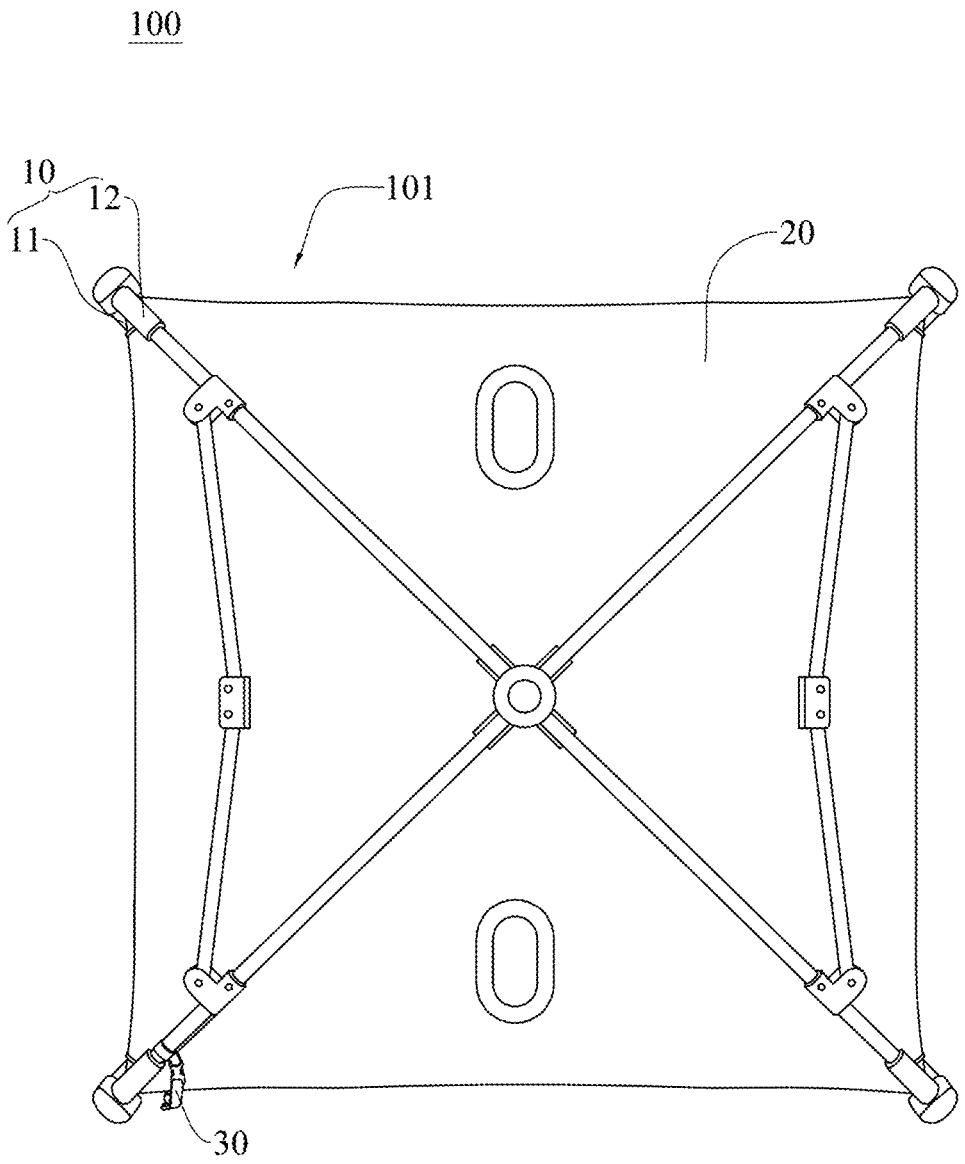
FIG. 3 is a structural schematic diagram of FIG. 1 from another angle.

Refer to FIG. 1 to FIG. 3. The disclosure provides a containing structure 100 suitable for protecting the infant. The containing structure 100 includes a main body 101 with a containing chamber 102, and a door body 21 is disposed on the main body 101 and is openable to enter the containing chamber 102. A connecting assembly 22 is disposed between the door body 21 and the main body 101, and is used to close and open the door body 21 on the main body 101. A locking assembly 30 is disposed on the containing structure 10 and is used to switch the connecting assembly 22 between a locking state and an unlocking state. When the door body 21 is closed, the connecting assembly 22 is located outside the main body 101 and is locked outside the main body 101 by the locking assembly 30, so as to prevent damage caused by improper operation of the infant. The door body 21 could be opened when the connecting assembly 22 is unlocked, which may effectively prevent infant from operating. Specifically, the main body 101 according to the disclosure may be any one of a crib, a stroller, a safety seat, or a sleeping box, and may also be a structure such as a playpen, which has a wide range of applications.

In comparison with the prior art, the containing structure 100 according to the disclosure is suitable for protecting the infant. The containing structure 100 includes a main body 101 with a containing chamber 102, and a door body 21 for allowing the infant to enter the containing chamber 102 is disposed on the main body 101. A connecting assembly 22 is disposed between the door body 21 and the main body 101, and the door body 21 may be opened or closed on the main body 101 by the connecting assembly 22. A locking assembly 30 is disposed on the containing structure 100 and is used to switch the connecting assembly 22 between a locking state and an unlocking state. In the containing structure 100 according to the disclosure, when the door body 21 is closed, the connecting assembly 22 is located outside the main body 101, so that the infant in the containing chamber 102 cannot touch the connecting assembly 22, which is safe and reliable. Moreover, the connecting assembly 22 may be locked outside the main body 101 by the locking assembly 30, such that the infant outside the containing chamber 102 cannot operate the connecting assembly 22, which may avoid hurt by jamming and is safer and more reliable. In the containing structure 100 according to the disclosure, when the door body 21 is closed, the connecting assembly 22 is locked outside the main body 101 by the locking assembly 30, so as to prevent the body from damage caused by improper operation of the infant; when the locking assembly 30 is unlocked, the connecting assembly 22 could be operated to open the door body 21, so as to obtain a simple, safe, and reliable structure and be suitable for wide promotion and use.

Refer to FIG. 1 to FIG. 8. In some alternative embodiments, when the door body 21 is closed, the connecting assembly 22 is located outside the main body 101, and is locked by the locking of the locking assembly 30. The connecting assembly 22 is unlocked by the unlocking of the locking assembly 30, such that the door body 21 can be opened. On one hand, the connecting assembly 22 is locked outside the main body 101 by the locking of the locking assembly 30. On the other hand, the connecting assembly 22 is unlocked by the unlocking of the locking assembly 30, such that the door body 21 may be opened with respect to the main body 101 by the connecting assembly 22. By providing the locking assembly 30, the connecting assembly 22 and the main body 101 may be switched between the locking state and the unlocking state, which is safer and more reliable.

Figure 5:
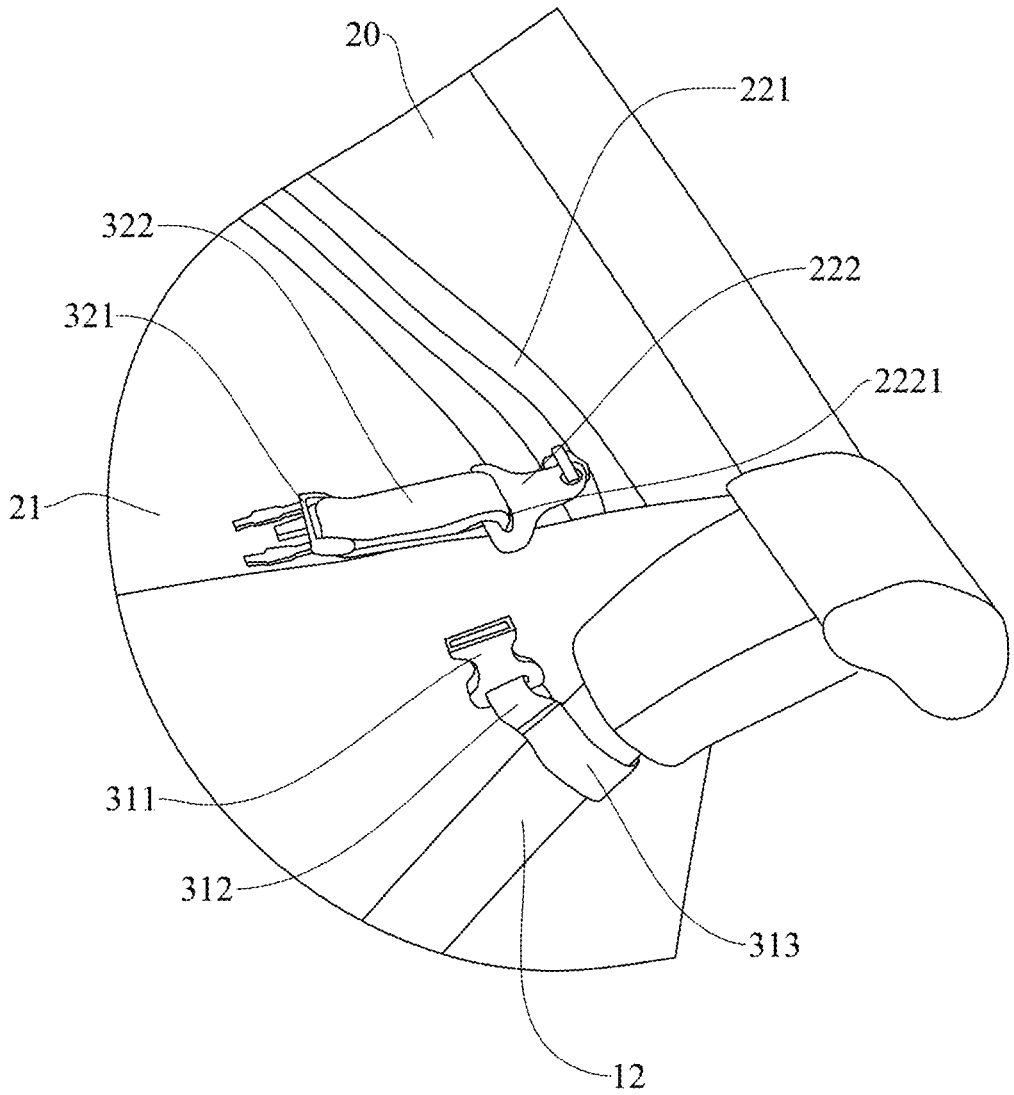
FIG. 5 is a structural schematic diagram of the locking assembly in the containing structure of FIG. 4 from another angle in another state.
Figure 6:
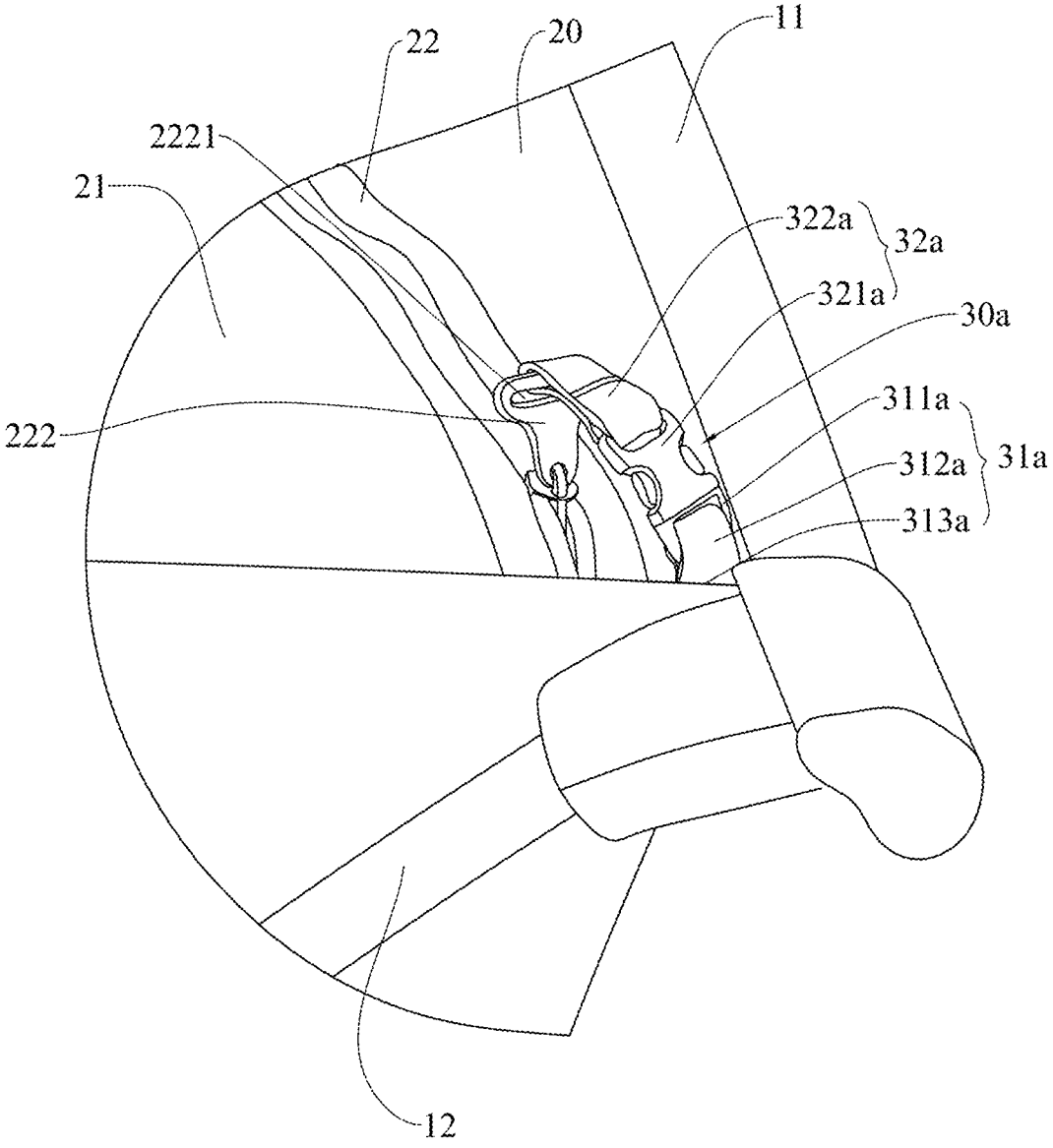
FIG. 6 is a partial structural schematic diagram of the locking assembly in the containing structure in another embodiment according to the disclosure.
Figure 7:
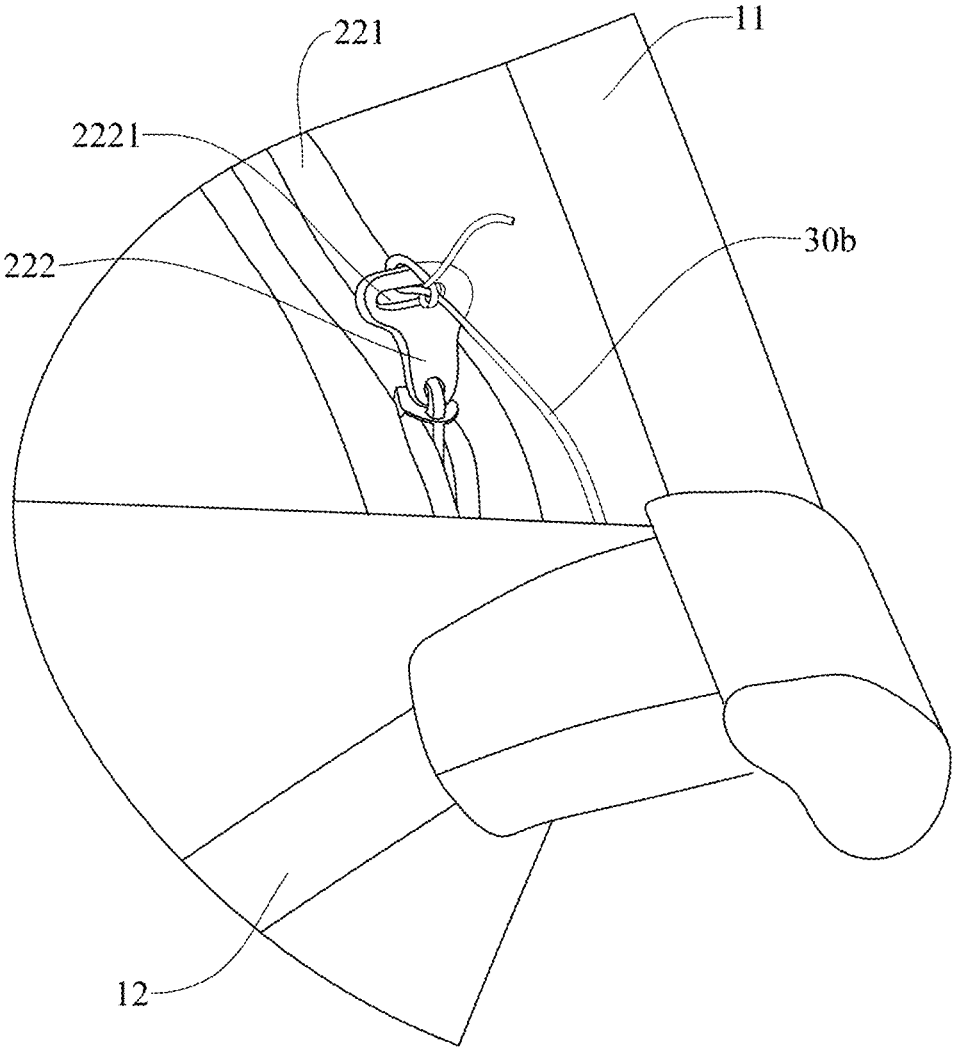
FIG. 7 is a partial structural schematic diagram of the locking assembly in the containing structure in another embodiment according to the disclosure.
Figure 8:
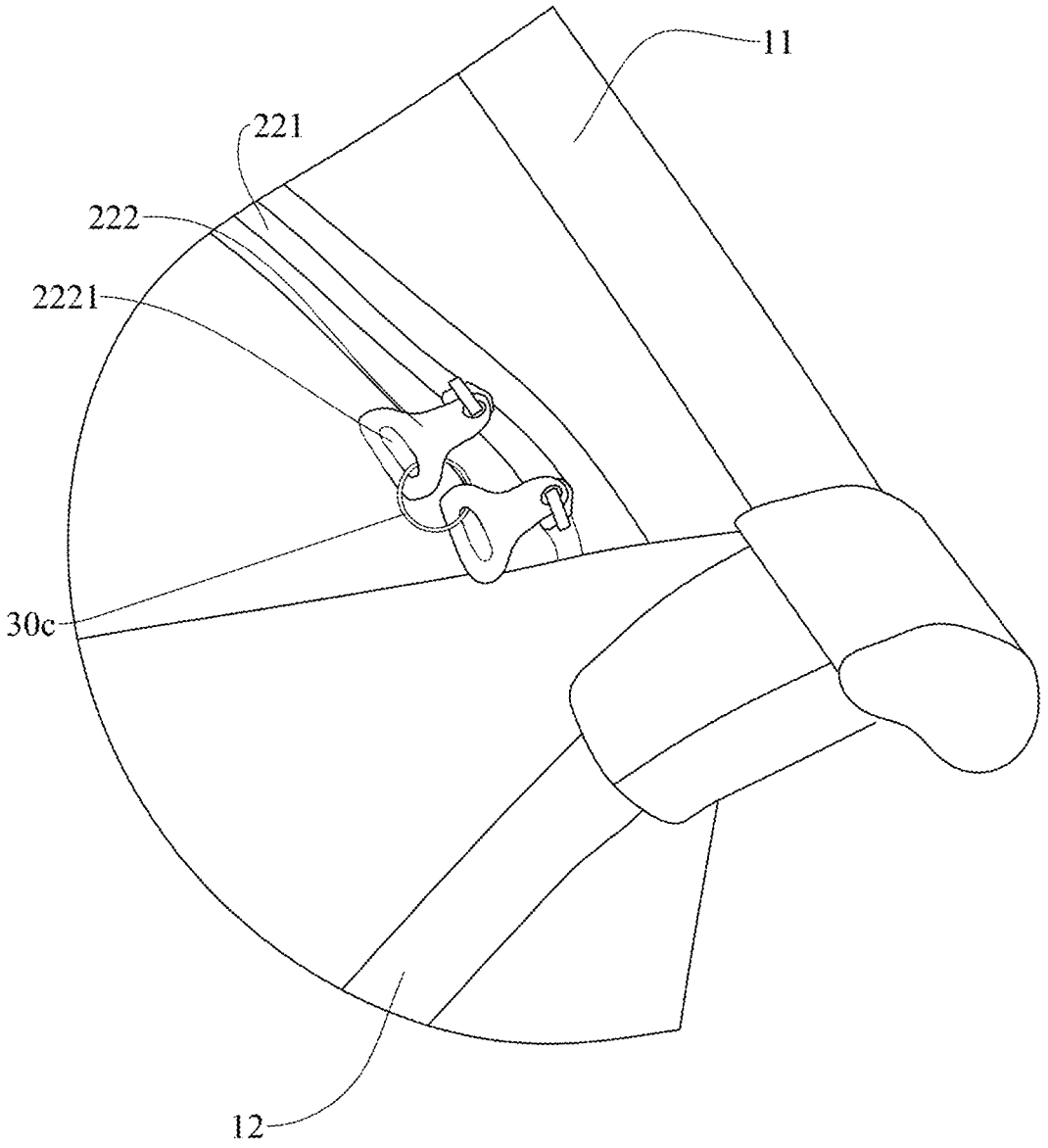
FIG. 8 is a partial structural schematic diagram of the locking assembly in the containing structure in another embodiment according to the disclosure.
Figure 9:
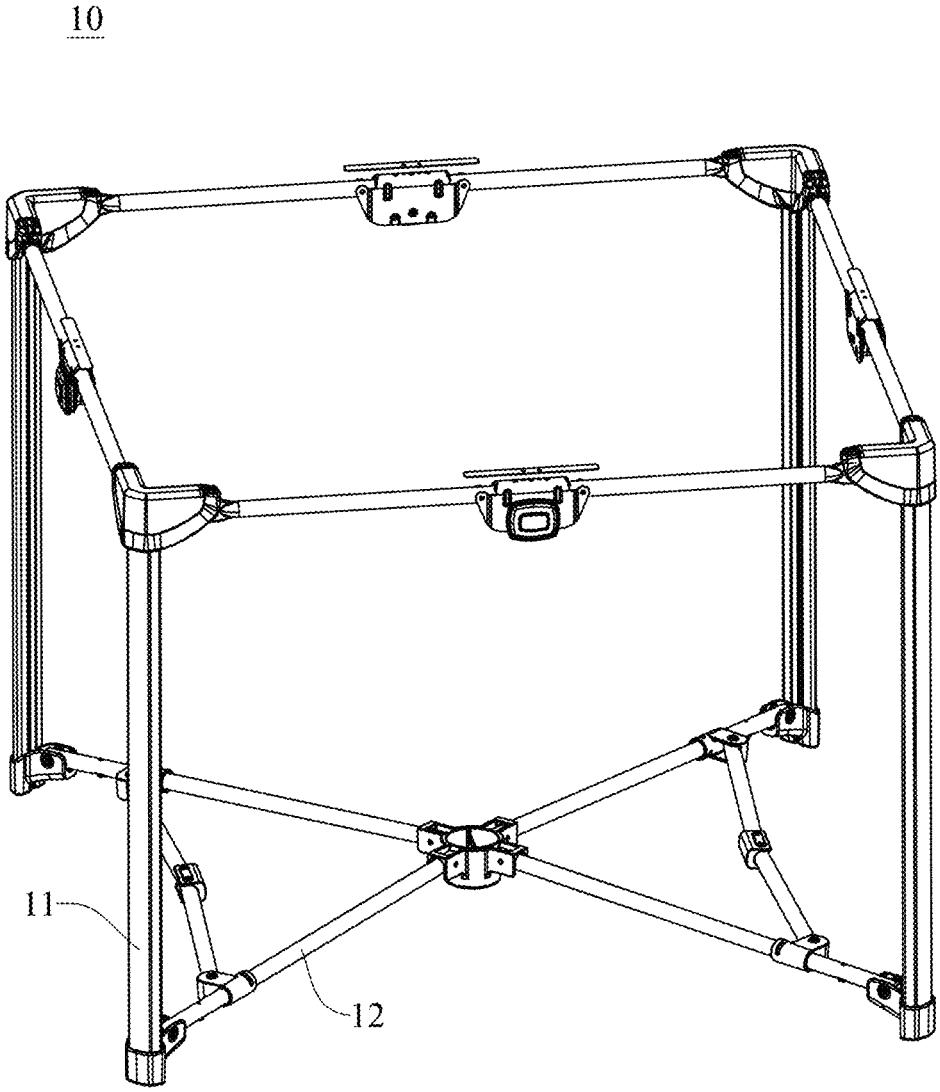
FIG. 9 is a structural schematic diagram of a supporting frame of FIG. 1.

Refer to FIG. 1 to FIG. 8. In some alternative embodiments, as shown in FIG. 8, the locking assembly 30*c* may be only arranged on the connecting assembly 22 to lock or unlock the connecting assembly 22. As shown in FIG. 7, the locking assembly 30*b* may also be only arranged on the main body 101 to lock and unlock the connecting assembly 22. As shown in FIG. 3 to FIG. 6, the locking assembly 30 may further include a first locking portion 311 and a second locking portion 321 which are detachably connected, wherein the first locking portion 311 is connected to the main body 101, and the second locking portion 321 is connected to the connecting assembly 22. The first locking portion 311 and the second locking portion 321 are connected to lock the connecting assembly 22 to the main body 101, which may avoid improper operation of the connecting assembly 22 by the infant and be safer and more reliable. The first locking portion 311 can be separated from the second locking portion 321 to unlock the connecting assembly 22 on the main body 101, such that the connecting assembly 22 may be operated to open the door body 21 with respect to the main body 101, which is convenient to use.

Refer to FIG. 1 to FIG. 3. In some alternative embodiments, the main body 101 includes a supporting assembly 10 and a seat cloth 20 sleeved on the supporting assembly 10. The seat cloth 20 is supported by the supporting assembly 10 and forms a containing chamber 102 for accommodating the infant. The door body 21 may be disposed on the seat cloth 20, and the door body 21 may also be opened and closed with respect to the seat cloth 20. In the embodiment, the main body 101 is a crib, the supporting assembly 10 is a bed frame, and the seat cloth 20 may be a bed skirt or a mosquito net covering the bed frame. Specifically, the connecting assembly 22 includes an operating element for operating the connecting assembly 22 to open or close the door body 21 with respect to the main body 101. Exemplarily, the connecting assembly 22 may be a zipper 221, and the operating element may be a zipper head 222. The door body 21 could be closed or opened with respect to the main body 101 by the zipper 221. The zipper 221 includes a zipper head 222 for operating. The number of the zipper head 222 may be one or two, and each zipper head 222 may include a fixing hole 2221 for fitting with the locking assembly 30. The zipper head 222 includes a fixing hole 2221 for more conveniently connecting with the locking assembly 30. The second locking portion 321 may be connected to the zipper head 222, and the first locking portion 311 may be arranged on the supporting assembly 10 or the seat cloth 20. When the door body 21 is closed, the zipper 221 is locked by fitting the first locking portion 311 and the second locking portion 321.

As shown in FIG. 8, when the number of the zipper head 222 is two, each locking assembly 30*c* may be arranged on the connecting assembly 22. When the door body 21 is closed, the locking assembly 30*c* is locked between the two zipper heads 222 to lock the connecting assembly 22, thereby restricting the opening of the connecting assembly 22. Exemplarily, when the number of the zipper head 222 is two, one zipper head 222 may include a buckle, that is, the locking assembly 30*c* is a buckle. The connecting assembly 22 is locked by the locking assembly 30*c*, for preventing the connecting assembly 22 from being opened by the infant. It may be understood that the locking assembly 30*c* is a buckle; and when the door body 21 is closed, the buckle is locked on the other zipper head 222, thereby restricting the opening of the connecting assembly 22. The two zipper heads 222 may be locked by other locking ways, and the two zipper heads 222 may be locked by the first locking portion 311 and the second locking portion 321 which are detachably connected, as long as the connecting assembly 22 could be locked outside the main body 101. The disclosure includes the above embodiments but is not limited thereto.

Refer to FIG. 1 to FIG. 5. In some alternative embodiments, the locking assembly 30 includes a first fixing member 31 on the main body 101 and a second fixing member 32 on the connecting assembly 22. The first fixing member 31 includes a first connecting member 312. One end of the first connecting member 312 is connected to the supporting assembly 10, and the first locking portion 311 is connected to the other end of the first connecting member 312. The first locking portion 311 is connected to the supporting assembly 10 by the first connecting member 312. The second fixing member 32 includes a second connecting member 322 for connecting with the connecting assembly 22. One end of the second connecting member 322 includes a second locking portion 321 for fitting with the first locking portion 311. The first connecting member 312 may be a flexible structure. Exemplarily, the first connecting member 312 may be a fabric tape. One end of the fabric tape includes a fixing portion 313 for connecting with the supporting assembly 10. The first connecting member 312 may be fixed on the supporting assembly 10, that is, the first connecting member 312 and the supporting assembly 10 are fixedly connected. The first connecting member 312 may be detachably installed on the supporting assembly 10 by the fixing portion 313. Specifically, the fixing portion 313 may be arranged around the supporting assembly 10. Or, the fixing portion 313 may be sleeved on the supporting assembly 10, that is, the supporting assembly 10 is inserted and installed in the fixing portion 313, and the supporting assembly 10 and the fixing portion 313 are detachably connected together. Or, the fixing portion 313 may be detachably attached and sleeved on the supporting assembly 10, that is, the fixing portion 313 may be a detachable and attachable Velcro (i.e., hook and loop fasteners) structure, which is more convenient for disassembly and installation. Or, the fixing portion 313 may be snap-fitted to the supporting assembly 10, that is, the fixing portion 313 is a snap-fitting, and the supporting assembly 10 includes a snap hole for engaging with the snap-fitting.

Figure 4:
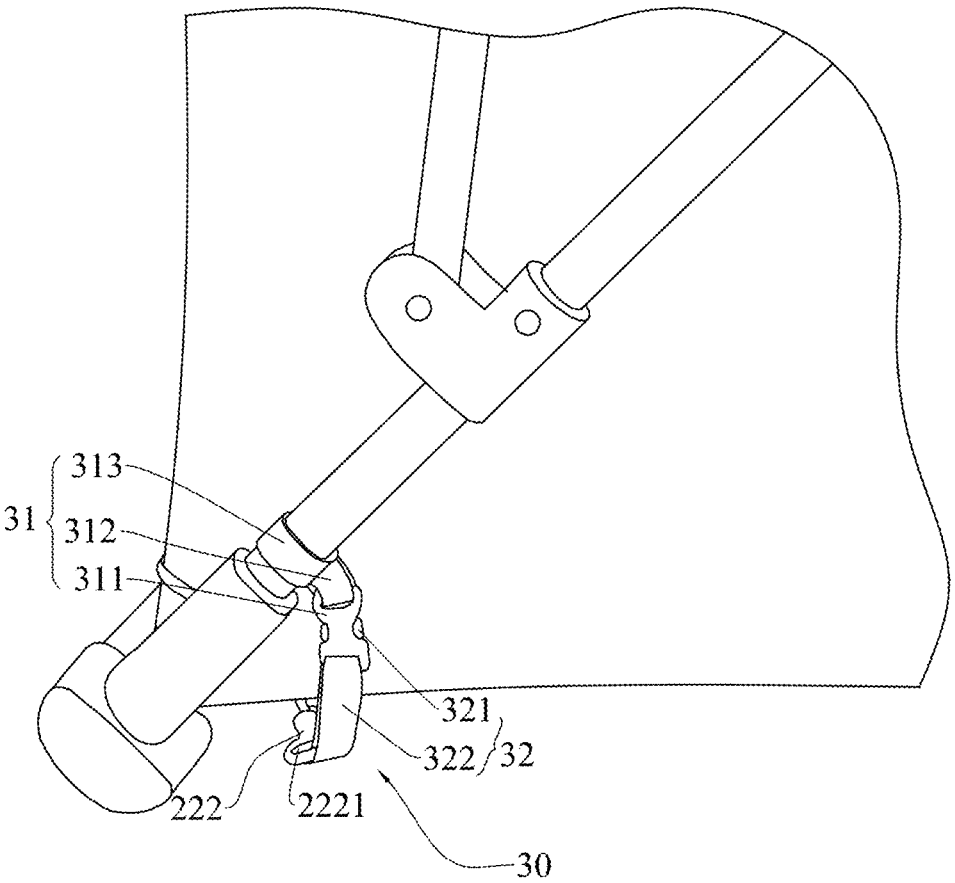
FIG. 4 is a partial structural schematic diagram of a containing structure in FIG. 3.

Refer to FIG. 4 and FIG. 5. In some alternative embodiments, the locking assembly 30 further includes a second connecting member 322. One end of the second connecting member 322 is connected to the connecting assembly 22. The second connecting member 322 may be a flexible structure, or may be a flexible fabric tape structure. One end of the second connecting member 322 may be connected to the fixing hole 2221 of the zipper head 222, and the second locking portion 321 is connected to the other end of the second connecting member 322. Exemplarily, the second locking portion 321 may be fixedly connected to the second connecting member 322 by sewing. The second locking portion 321 is connected to the connecting assembly 22 by means of the second connecting member 322, that is, the second locking portion 321 is connected to the zipper head 222 of the connecting assembly 22 by the second connecting member 322.

Refer to FIG. 3 to FIG. 5 and FIG. 9. In some alternative embodiments, the supporting assembly 10 includes a foldable bracket 11 and a bottom frame 12, that is, the supporting assembly 10 may be folded to facilitate storing. The bracket 11 is connected to bottom frame 12, while the fixing portion 313 is connected to the bottom frame 12. The fixing portion 313 may also be connected to the bracket 11, and the connection position between the fixing portion 313 and the supporting assembly 10 may be set according to actual requirements. Specifically, the connection position between the fixing portion 313 and the supporting assembly 10 may be set according to the position of the connecting assembly 22 on the main body 101 when the door body 21 and the seat cloth 20 are closed. The fixing portion 313 and the bracket 11 or the bottom frame 12 may be detachably connected, and the connection position between the fixing portion 313 and the supporting assembly 10 may be adjusted according to actual requirements, such that the locking assembly 30 could lock the connecting assembly 22 outside the main body 101.

Refer to FIG. 6. In some alternative embodiments, the locking assembly 30*a* includes a first fixing member 31*a* and a second fixing member 32*a* which are separated. The first fixing member 31*a* includes a first connecting member 312*a*. One end of the first connecting member 312*a* is fixed to the seat cloth 20, that is, the fixing portion 313*a* is located on the seat cloth 20, and the first locking portion 311*a* is connected to the other end of the first connecting member 312*a*. The second fixing member 32*a* includes a second connecting member 322*a* for connecting with the connecting assembly 22, and one end of the second connecting member 322*a* includes a second locking portion 321*a* for engaging with the first locking portion 311*a*. The first connecting member 312*a* may be a flexible structure. Exemplarily, the first connecting member 312*a* may be a fabric tape. Two ends of the fabric tape are fixedly connected with the seat cloth 20*a* and the first locking portion 311*a*, respectively. It may be understood that the two ends of the fabric tape may be fixedly connected with the seat cloth 20*a* and the first locking portion 311*a* by sewing, respectively. The connection position between the first connecting member 312 and the seat cloth 20 may be set according to the position of the connecting assembly 22 on the main body 101 when the door body 21 and the seat cloth 20 are closed, for locking the connecting assembly 22 outside the main body 101. Specifically, the first connecting member 312*a* may be located outside the door body 21 and fixed on a surface of the seat cloth 20 including the door body 21. The first connecting member 312*a* may also be fixed on a surface of the seat cloth 20 adjacent to the door body 21, that is, the first connecting member 312*a* may be fixed to the top surface or the side surface or the bottom surface of the seat cloth 20. The first connecting member 312*a* may also be fixed on the door body 21.

Refer to FIG. 6. In some embodiments, the locking assembly 30*a* also includes a second connecting member 322*a*. One end of the second connecting member 322*a* is connected to the connecting assembly 22. Specifically, the second connecting member 322*a* may be a flexible fabric tape structure. One end of the second connecting member 322*a* is connected in the fixing hole 2221 of the zipper head 222, while the other end of the second connecting member 322*a* is connected to the second locking portion 321*a*. Exemplarily, the second connecting member 322*a* may be fixedly connected to the fixing hole 2221 of the zipper head 222 by sewing, and the second locking portion 321*a* may also be fixedly connected to the second connecting member 322*a* by sewing. By the second connecting member 322*a*, the second locking portion 321*a* is connected to the connecting assembly 22, that is, the second locking portion 321*a* is connected to the zipper head 222 of the connecting assembly 22 by the second connecting member 322*a*.

Refer to FIG. 4 to FIG. 6. In some alternative embodiments, the first locking portion 311 and the second locking portion 321 are in a detachable plug-in fitting structure. Exemplarily, when the first locking portion 311 is a male buckle, the second locking portion 321 may be a female buckle for engaging with the male buckle. Or, when the first locking portion 311 is a female buckle, the second locking portion 321 is a male buckle for engaging with the female buckle. The first locking portion 311 and the second locking portion 321 may be in an engagement structure with male and female buckles, which makes both locking and unlocking simple and easy, and provides a good protective effect in order to prevent the body from damage caused by improper operation of the infant.

In some alternative embodiments, the first locking portion 311 and the second locking portion 321 are in a detachable paste-fitting structure (not shown). Specifically, the first locking portion 311 may be a first Velcro, while the second locking portion 321 may be a second Velcro for engaging with the first Velcro. The first locking portion 311 and the second locking portion 321 may be attachable Velcros, which makes both locking and unlocking simple and easy and prevents the body from damage caused by improper operation of the infant.

In some alternative embodiments, the first locking portion 311 and the second locking portion 321 are in a detachable suction-fitting structure (not shown). Specifically, the first locking portion 311 may be a first magnetic element, while the second locking portion 321 may be a second magnetic element for engaging with the first magnetic element. The first locking portion 311 and the second locking portion 321 are locked by suction, and the first locking portion 311 and the second locking portion 321 can be separated to unlock, which makes the structure simple and the operation convenient, and provides a good protective effect for preventing the body from damage caused by improper operation of the infant.

In some alternative embodiments, the first locking portion 311 and the second locking portion 321 are in a detachable sleeve-fitting structure (not shown). Specifically, the first locking portion 311 is a rope loop, while the second locking portion 321 is a rod for inserting into the rope loop; or, the first locking portion 311 is a rod, while the second locking portion 321 is a rope loop into which the rod is inserted. Exemplarily, the first locking portion 311 may be a rod, while the fixing hole 2221 on the zipper head 222 may be a rope loop, and the rod may extend into the fixing hole 2221 to lock the connecting assembly 22. Or, the first locking portion 311 is a button, while the second locking portion 321 is a buttonhole for engaging with the button; or, the first locking portion 311 is a buttonhole, while the second locking portion 321 is a button for engaging with the buttonhole. It may be understood that the button and the buttonhole may be provided on the first connecting member 312 and the second connecting member 322. The sleeve-fitting structure, like the button and buttonhole engaging structure, makes the structure simple and the operation convenient, and may effectively prevent the body from damage caused by improper operation of the infant.

Refer to FIG. 7. In some alternative embodiments, the first locking portion 311 and the second locking portion 321 are in a detachable lace-fitting structure. Specifically, the first locking portion 311 is a first lace, while the second locking portion 321 is a second lace for engaging with the first lace (i.e., tie); or, the first locking portion 311 is a first lace, while the second locking portion 321 is a hole structure for engaging with the first lace; or, the first locking portion 311 is a hole structure, while the second locking portion 321 is a second lace for engaging with the hole structure. Exemplarily, as shown in FIG. 7, the locking assembly 30*b* is a lace, one end of the locking assembly 30*b* is fixed to the seat cloth 20 by sewing, and the other end of the locking assembly 30*b* passes through the fixing hole 2221 of the zipper head 222 to lock the connecting assembly 22, which makes the structure simple and the operation convenient, and may effectively prevent the body from damage caused by improper operation of the infant.

As shown in FIG. 1 to FIG. 9, the containing structure 100 according to the disclosure may protect the infant. The containing structure 100 includes a main body 101 with a containing chamber 102, and the main body 101 includes a door body 21 for allowing the infant to enter the containing chamber 102. The main body 101 may be any of a crib, a stroller, a safety seat, or a sleeping box, and may also be a structure such as a playpen, which has a wide range of applications. A connecting assembly 22 is arranged between the door body 21 and the main body 101, and the door body 21 may be opened or closed on the main body 101 by the connecting assembly 22. In the containing structure 100 according to the disclosure, when the door body 21 is closed, the connecting assembly 22 is located outside the main body 101, such that the infant in the containing chamber 102 cannot touch the connecting assembly 22, which is safe and reliable. Moreover, the connecting assembly 22 may be locked outside the main body 101, such that the infant outside the containing chamber 102 cannot operate the connecting assembly 22, which is safer and more reliable. In addition, the locking assembly 30 for locking the connecting assembly 22 according to the disclosure has various optional structures, is simple and easy to operate, is convenient to realize, and provides effective protection to the infant. In the containing structure 100 according to the disclosure, when the door body 21 is closed, the connecting assembly 22 is located outside main body 101 and may be locked by the locking assembly 30, so as to prevent the body from damage caused by improper operation of the infant; when the locking assembly 30 is unlocked, the connecting assembly 22 may be operated to open the door body 21, which is simple in structure, is safe and reliable, and is suitable for widespread use.

The above disclosed contents only relate to some examples of the present disclosure, but cannot be used to limit the claimed scope of the disclosure. Therefore, all equivalent modifications made according to the claims of the disclosure fall within the scope of the disclosure.

What is claimed is:

1. A containing structure comprising:

a main body with a containing chamber, the main body comprising a supporting assembly and a seat cloth, a door body disposed on the seat cloth and openable to enter the containing chamber, a connecting assembly disposed between the door body and the seat cloth, and used to open and close the door body on the main body, and a locking assembly connected to a bottom frame of the supporting assembly and used to switch the connecting assembly between a locking state and an unlocking state;

wherein the locking assembly comprises a first locking portion and a second locking portion which are detachably connected, the first locking portion is connected with the supporting assembly, the second locking portion is connected with the connecting assembly, and the first locking portion is connected with the second locking portion, such that the connecting assembly is locked, and the first locking portion is detached from the second locking portion, such that the connecting assembly is unlocked.

2. The containing structure according to claim 1, wherein when the door body is closed, the connecting assembly is located outside the main body and locked by locking of the locking assembly, and the connecting assembly is unlocked by unlocking of the locking assembly so as to open the door body.

3. The containing structure according to claim 1, wherein the first locking portion and the second locking portion are in any one of: a detachable plug-fitting structure, a detachable paste-fitting structure, a detachable suction-fitting structure, a detachable sleeve-fitting structure, and a detachable lace-fitting structure.

4. The containing structure according to claim 1, wherein the seat cloth is sleeved on the supporting assembly, and the seat cloth is supported on the supporting assembly to form the containing chamber.

5. The containing structure according to claim 4, wherein the door body is openable and closable with respect to the seat cloth.

6. The containing structure according to claim 4, wherein the locking assembly further comprises a first connecting member, and the first connecting member has one end connected to the first locking portion, and the other end connected to the supporting assembly.

7. The containing structure according to claim 6, wherein the first connecting member is a flexible structure.

8. The containing structure according to claim 6, wherein a fixing portion for connecting with the supporting assembly is provided on an end of the first connecting member.

9. The containing structure according to claim 8, wherein the first connecting member is detachably installed on the supporting assembly through the fixing portion.

10. The containing structure according to claim 8, wherein the fixing portion is any one of: arranged around the supporting assembly, sleeved on the supporting assembly, detachably sleeved on and abutted against the supporting assembly, and snap-fitted on the supporting assembly.

11. The containing structure according to claim 8, wherein the supporting assembly comprises a bracket and the bottom frame which are foldable, the bracket is connected to the bottom frame, and the fixing portion is connected to the bottom frame.

12. The containing structure according to claim 4, wherein the locking assembly further comprises a second connecting member, the second connecting member has one end for connecting to the connecting assembly and the other end for connecting to the second locking portion, such that the second locking portion is connected to the connecting assembly through the second connecting member.

13. The containing structure according to claim 1, wherein the main body is any one of a crib, a stroller, a safety seat, and a sleeping box.

14. A containing structure comprising:

a main body with a containing chamber, the main body comprising a supporting assembly and a seat cloth, a door body disposed on the seat cloth and openable to enter the containing chamber, a connecting assembly disposed between the door body and the seat cloth and used to open and close the door body on the main body, and a locking assembly disposed on the containing structure and used to switch the connecting assembly between a locking state and an unlocking state, the locking assembly comprises:

a first locking portion and a second locking portion which are detachably connected, the first locking portion is connected with the main body, the second locking portion is connected with the connecting assembly, and the first locking portion is connected with the second locking portion, such that the connecting assembly is locked, and the first locking portion is detached from the second locking portion, such that the connecting assembly is unlocked, and a first connecting member, the first connecting member has a first end fixedly connected with the first locking portion, and a second end fixedly connected with the seat cloth.

15. The containing structure according to claim 14, wherein the first connecting member is fixed on any one of:

a surface of the seat cloth disposed with the door body, a surface of the seat cloth adjacent to the door body, and the door body.

16. The containing structure according to claim 14, wherein the main body is any one of a crib, a stroller, a safety seat, and a sleeping box.

* * * * *